United States Patent [19]

Anderson

[11] Patent Number: 5,003,690

[45] Date of Patent: Apr. 2, 1991

[54] FINNING AND THREAD ROLLING MACHINE

[76] Inventor: Ray C. Anderson, 7605 S. Quebec, Tulsa, Okla. 74136

[21] Appl. No.: 242,291

[22] Filed: Sep. 9, 1988

[51] Int. Cl.[5] ..... B23P 15/26

[52] U.S. Cl. ..... 29/727; 29/33 D; 29/33 T; 29/890.48; 29/890.5; 72/96; 72/98; 72/100

[58] Field of Search ..... 72/96, 98, 100; 29/33 G, 33 T, 33 K, 33 R, 33 D, 157.3 R, 157.3 AH, 157.3 H, 157.4, 456, 457, 561, 564, 234, 240.5, 727, 890.48, 890.5, 890.53

[56] References Cited

U.S. PATENT DOCUMENTS

| | | | |
|---|---|---|---|
| 1,472,719 | 10/1923 | Horvath | 29/33 G |
| 1,884,203 | 10/1932 | Pickhard | 29/157.3 R |
| 2,152,437 | 3/1939 | Lear | 29/33 G |
| 2,374,144 | 4/1945 | Stikeleather | 29/33 G |
| 3,004,387 | 6/1935 | Dewald | 29/33 G |
| 3,055,082 | 9/1962 | Garland | 29/33 G |

*Primary Examiner*—Howard N. Goldberg
*Assistant Examiner*—I. Coda
*Attorney, Agent, or Firm*—Robert B. Stevenson

[57] ABSTRACT

A finning and thread rolling machine capable of producing an integral finned tube, an extended finned tube or a wrap-on finned tube, whichever is desired, the tubing to be used for extended surface heat transfer. Types of tubes produced are integral low finned tube, bi-metal fin tube with extruded high finned tube on the outer portion, and extruded integral/high finned tube and spiral strip helical wrap-on finned tube. The apparatus also provides a two and three die thread rolling machine for thru-feed threading and form rolling.

2 Claims, 3 Drawing Sheets

HIGH FIN TUBE
LOW FIN TUBE
THREADED ROD
WRAP-ON FIN TUBE

FINNING AND THREAD ROLLING MACHINE

BACKGROUND OF THE INVENTION

1. Field of the Invention

The invention relates generally to heat exchanger tubing and more particularly to the manufacturing of extended surface tubing for heat exchangers.

2. Description of the Prior Art

Machines now in use to produce finned tubing require the disassembling of the head portion and removal thereof and the reinstallation of a new head for each change in tubing diameter. Also the machines are limited to produce but one product from each type machine; i.e., integral low fin, integral high fin or spiral strip helical wrap-on fin.

SUMMARY OF THE INVENTION

The present invention produces all of the above-mentioned finned tubes and types of fin using the same machine with minimum change time and less machine parts and tooling. This invention employs the use of a chuck, (e.g., a three jaw chuck as shown in the drawing) wherein to change from one tubing diameter to another, and simply moves the jaws or arbor blocks up or down or thus adjusting the chuck jaw serrations to the changed diameter. The drive system powers the driveshafts connected to the arbors onto which the finning discs are placed and the arbor blocks are angled to produce a helix angle for the fins. When the discs are powered or rotating and the arbor blocks attached to the chuck closes, the discs penetrate the tube and produces an integral/extruded fin. The arbor blocks may remain in the closed position and with the discs rotating engage the raw stock into the discs which will produce an extruded fin. A most unique feature of this invention is the use of the thru-hole power chuck for mounting of the arbor blocks. Adjustment of the arbor blocks on the chuck serrations and the use of the power chuck self contained internal wedge action to move the arbor blocks, or discs all equally out of the material or back into the material produces stopping of the arbor blocks or disc precisely and equally with only a one stop adjustment.

To produce the wrap-on fin, the transmission, is used to reverse the direction of rotation and the finning discs on the arbors are changed to one piece relatively smooth driving wheels. This will rotate the tube and drive the tube forward due to the helix angle offset on the arbor blocks, when the chuck is closed and the drive wheels come in contact with the tubing. The fin strip from the fin strip coil is passed through the form rolls to form the base of the "L" fin. The strip advances toward the tube, pulled by the pressure roll pressing the strip against the powered spinning tube guide. Pressure is directed against the fin strip, pressing the strip against the spinning tube guide to thin out the strip from the base of the strip to the outer edge, progressively thinner, to allow the strip to wrap around the tube without tearing. The formed base of the "L" strip lies on the upper outer edge of the pressure roll prior to wrapping around the tube. To produce a threaded rod, the transmission is shifted to the forward direction associated with the making of finned tubes and the smoothed driving wheels or finning discs are changed to cylindrical dies for rolling threads. The dies are set to the desired depth by closing the chuck on the adjusting screw, thus moving the arbor blocks down. The motor will drive the three cylindrical dies in a rotating motion. The stock to be threaded is fed into the dies and the dies which are set on a helical angle and rotating will grab the stock and feed it through the dies producing a threaded rod, tube or bar. The adjustable arbor blocks holding the cylindrical thread dies can remain in the rolling position for continuous thru-feed threading of long or short work. If required, the chuck jaws may be opened and closed during operation thereby disengaging and engaging the cylindrical thread dies at intervals on the threaded rod, tube or bar. The same sequence of operation would be used for a two die thread rolling application.

DESCRIPTION OF THE PREFERRED EMBODIMENT

Figures 1, 2, 7:
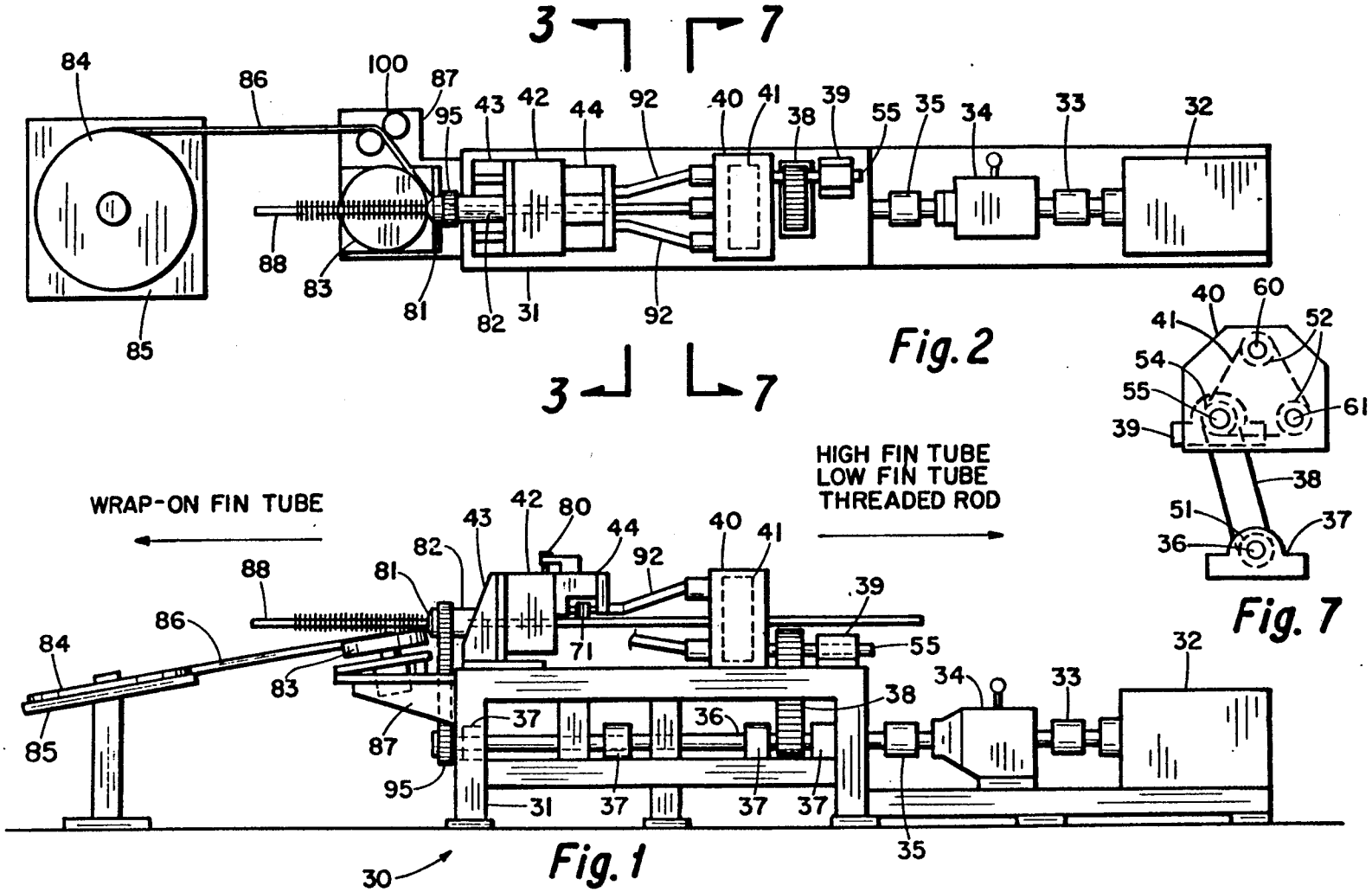
FIG. 1 is a schematic overall side view illlustration of the finning machine of the present invention.
FIG. 2. is schematic overall top view illustration of the finning maching of the present invention.
FIG. 7 is a fragmentary view of chain drive system taken on line A—A of FIG. 2.
Figure 11:
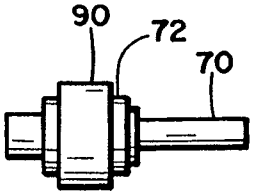
FIG. 11 is a side view of a smooth drive wheel mounted on arbor.
Figure 4:
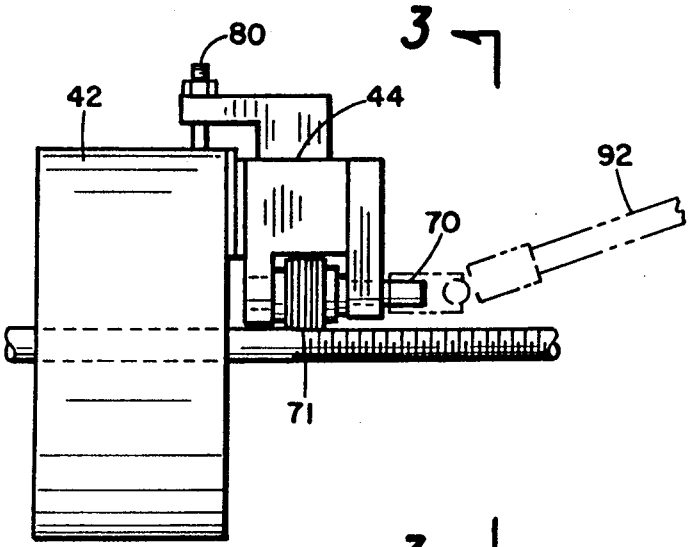
FIG. 4 is a side view projection of chuck and arbor blocks taken from FIG. 3.
Figure 6:
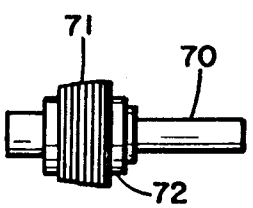
FIG. 6 is a side view of arbor with finning discs and hold-down nut taken from FIG. 4.

The finning machine of the present invention is designated generally by the numeral 30 and is illustrated in schematic form in FIG. 1. The finning machine comprises a base 31 and a motor 32. The drive system comprises a coupling 33, a transmission 34, coupling 35 attached to jackshaft 36 which is held by bearings 37. Sprocket 51 (see FIG. 7) is mounted on jackshaft 36 and the chain 38 is over sprocket 51 to transfer motion. Chain 38 is in a loop form rising up to sprocket 54 (again see FIG. 7) mounted on shaft 55, supported by bearing 39. Shaft 55 extends through universal joint drive system housing 40 and sprocket 52 (see FIG. 7) is attached internally to shaft 55. Sprockets 52 are also mounted internally to shaft 60 and shaft 61. Loop chain 41 wraps around sprockets 52 to form a drive system for shaft 60 and shaft 61. When motor 32 is running and transmission 34 is in gear, the drive train heretofore described will power the shaft 55, shaft 60 and shaft 61. Mounted on shaft 55, shaft 60 and shaft 61, are universal joint drives 92, which are attached at the opposite end to the arbors 70 (see FIG. 4). Arbors 70 are held in place by the arbor blocks 44 and the arbors 70 are free to rotate. Mounted on the arbors 70 are the discs 71 which do the finning and are held in place by nut 72 (see FIGS. 6 and 11). The arbor blocks 44 are bolted to the sliding jaws of the chuck 42. On opening and closing of the jaws in the chuck 42 the depth traveled by the discs 71 is controlled by the adjusting screw 80 to produce integral/extruded fins to the exact height required.

Figure 5:
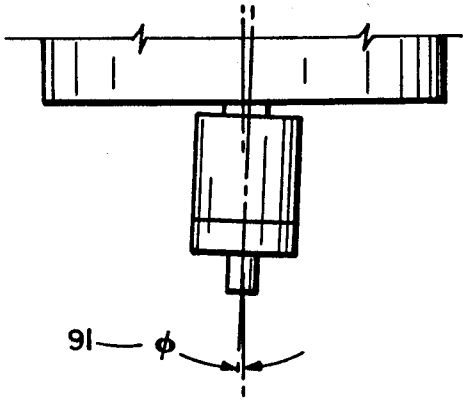
FIG. 5 is a top view projection of chuck arbor block showing helix angle offset of arbor block taken from FIG. 3.
Figure 10:
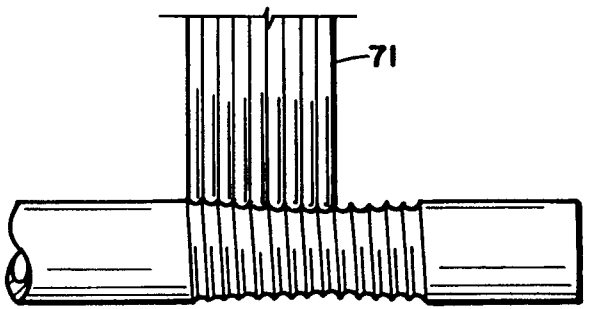
FIG. 10 is an enlarged view of finning discs, finning tube.
Figure 3:
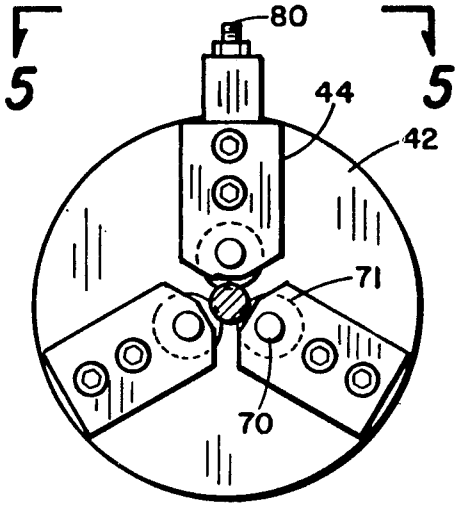
FIG. 3 is an enlarged fragmentary view of chuck and arbor blocks taken on line B—B of FIG. 2.
Figure 8:
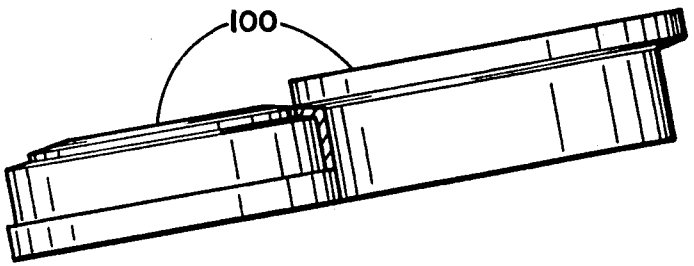
FIG. 8 is a side view of strip forming rolls.
Figure 9:
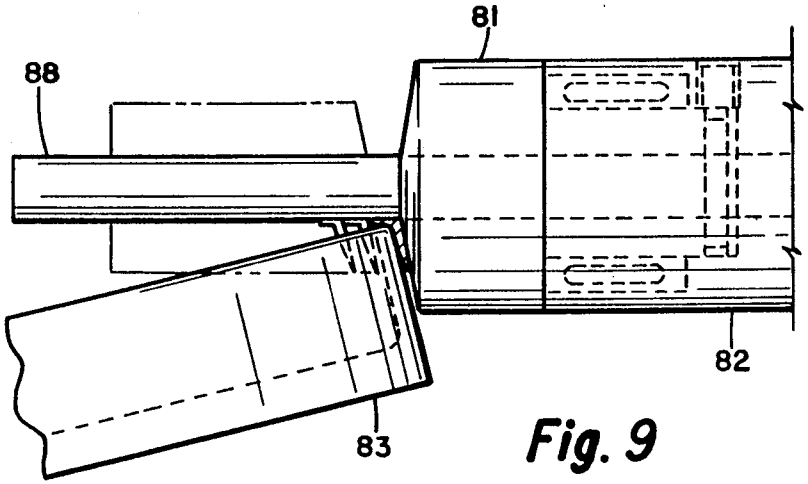
FIG. 9 is an enlarged fragmentary view of tube guide and pressure roll.

To produce a spiral strip helical wrap-on fin tube, the machine 30 comprises a tube guide 81 which is free to rotate in block 82 (see FIG. 9). The tube guide 81 has an angular face to match the angle of the pressure roll 83. The fin strip coil 84 (see FIGS. 1 and 2) is resting on coil stand 85 and is free to unwind. The fin strip 86 passes through form rolls 100 (see FIG. 8) which forms the "L" on the strip 86. This "L" form is upside down in forming, the base of the "L" will rest on the tubing 88 underside, outside diameter, while the leg of the "L" is squeezed between the angular face on tube guide 81 and the pressure roll 83. This squeezing action thins out the fin from the base of the fin to the top of the fin to allow the fin to wrap around the tube 88 without tearing. The tube guide 81 is powered by a chain 95 attached to jackshaft 36 which in turn powers the fin strip 86 when squeezed between the tube guide 81. The tube 88 is powered in rotation and forward with the smooth drive wheels 90 (see FIG. 11) mounted on the arbors 70 in place of the discs 71. The helix angle 91 (see FIG. 5) on the arbor blocks 44 provide the forward motion in conjunction with the arbors 70 turning and the smooth drive wheels 90 pressing against the tube.

Figure 12:
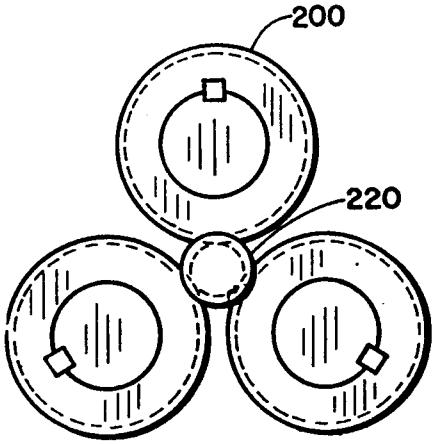
FIG. 12 is a front view of three cylindrical dies engaged into a bar and rolling threads.
Figure 13:
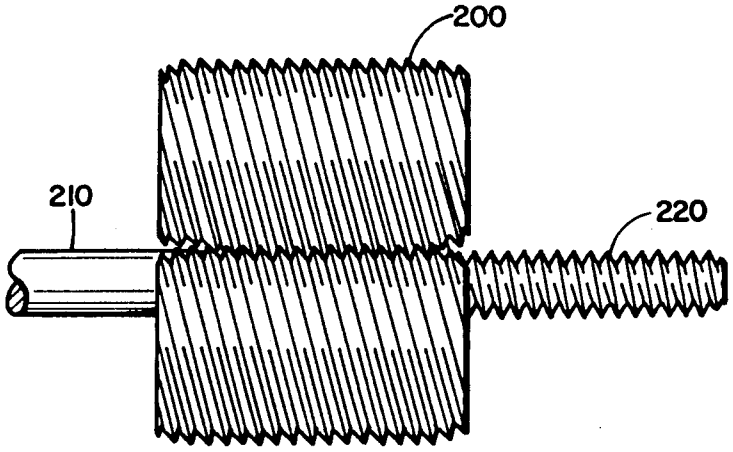
FIG. 13 is a side view of three cylindrical dies engaged into a bar and rolling threads.

To produce a threaded rod, tube or bar, place the cylindrical thread rolling dies 200 (see FIG. 13) on arbors 70. Install this assembly into arbor blocks 44 and attach universal joint drive shafts 92 to arbors 70. Adjust depth of arbor blocks 44 with adjusting screw 80. This in turn will adjust depth of cylindrical thread rolling dies 200 into bar or rod 220 (see FIG. 12). Start motor 32 which rotates thread rolling dies 200. Feed blank rod 210 into rotating dies 200 which will produce the threaded rod 220. The adjustable arbor blocks 44 can remain in the rolling position for continuous thru-feed threading of long or short work. The arbor blocks can be actuated into the work and out of the work to produce skip threading if so desired.

It is to be understood that the embodiments shown and described are by way of example only and that many modifications can be made thereto without departing from the spirit of the invention. The invention is not to be construed as limited to the embodiments shown and described except insofar as the claims may be so limited.

I claim:

1. A finning and thread rolling machine capable of producing extruded fins, helical wrap-on fins, and threaded rod or bar comprising:

(a) a base;

(b) a motor supported by said base;

(c) a drive system means operatively powered by said motor including a transmission for selectively engaging, disengaging and reversing rotational power to a thru-hole power chuck means, to a plurality of finning discs, smooth drive wheels or threaded rolling dies rotatably mounted to a plurality of arbor means and to a tube guide with pressure roll means;

(d) a thru-hole power chuck means operatively driven by said drive system including a plurality of individual jaws for accepting feed stock material therethrough during finning, helical wrapping or threading of said feed stock material wherein each individual jaw of said thru-hole power chuck means attaches to and simultaneously advances, holds stationary or withdraws a plurality or arbor blocks radially about said feed stock material;

(e) a plurality of arbor blocks with rotationally powered arbor means operatively driven by said drive system wherein each arbor block with arbor means is operatively attached to one of said jaws of said thru-hole power chuck means and wherein each of said arbor means further comprise a rotatable tool that can be advanced towards, held in contact with or withdrawn from said feed stock material during the finning, helical wrapping or threading of said feed stock material, said rotatable tool being selected from the group consisting of finning disc, smooth drive wheel and threaded rolling die; and (f) a tube guide with pressure roll means operatively driven by said drive system for selectively wrapping a helical spiral strip on to said feed stock material.

2. A finning and thread rolling machine of claim 1 wherein said thru-hole power chuck further comprises a single adjustable stop means to adjust for various work diameters.

* * * * *